US011752787B2

(12) United States Patent
Snir et al.

(10) Patent No.: US 11,752,787 B2
(45) Date of Patent: Sep. 12, 2023

(54) GRIPPER MECHANISM FOR GARMENT PRINTER

(71) Applicant: Kornit Digital Ltd., Rosh HaAyin (IL)

(72) Inventors: Ohad Snir, Kiryat-Ono (IL); Nuriel Amir, Yokneam Ilit (IL)

(73) Assignee: Kornit Digital Ltd., Rosh HaAyin (IL)

( * ) Notice: Subject to any disclaimer, the term of this patent is extended or adjusted under 35 U.S.C. 154(b) by 0 days.

(21) Appl. No.: 16/763,238

(22) PCT Filed: Nov. 12, 2018

(86) PCT No.: PCT/IL2018/051218
§ 371 (c)(1),
(2) Date: May 12, 2020

(87) PCT Pub. No.: WO2019/092727
PCT Pub. Date: May 16, 2019

(65) Prior Publication Data

US 2020/0307277 A1 Oct. 1, 2020

Related U.S. Application Data

(60) Provisional application No. 62/584,831, filed on Nov. 12, 2017.

(51) Int. Cl.
*B41J 13/22* (2006.01)
*B41J 3/407* (2006.01)
(Continued)

(52) U.S. Cl.
CPC ..... *B41J 13/22* (2013.01); *B41J 3/4078* (2013.01); *B65H 5/04* (2013.01); *B65H 5/10* (2013.01);
(Continued)

(58) Field of Classification Search
CPC ... B41J 3/22; B41J 3/4078; B41J 11/06; B41J 15/18; B65H 5/04; B65H 5/10; B65H 2701/174
See application file for complete search history.

(56) References Cited

U.S. PATENT DOCUMENTS 5,425,319 A * 6/1995 Resta ..... B65H 5/10 112/118
6,276,274 B1 8/2001 Hoffman, Jr. et al.
(Continued)

FOREIGN PATENT DOCUMENTS

CN 104379353 2/2015
EP 1147890 10/2001
(Continued)

OTHER PUBLICATIONS

International Preliminary Report on Patentability dated May 22, 2020 From the International Bureau of WIPO Re. Application No. PCT/IL2018/051218. (7 Pages).
(Continued)

*Primary Examiner* — Jill E Culler

(57) ABSTRACT

A device for positioning a garment on a printing platen for printing, comprises a gripper to controllably grip onto a first edge of the garment at a first side of the platen; and a sliding mechanism connected to the gripper to slide the gripper from the first side of the platen to a second side of the platen opposite the first side, thereby to pull the garment edge to the second side across the platen and position the garment across the platen for printing. The use of the device may prevent back pain related to repeated loading and unloading of platen-based textile printing devices.

11 Claims, 7 Drawing Sheets

(51) Int. Cl.

| | |
|---|---|
| ***B65H 5/10*** | (2006.01) |
| ***B65H 5/04*** | (2006.01) |
| *B41F 15/18* | (2006.01) |
| *B41J 11/06* | (2006.01) |

(52) U.S. Cl.
CPC ..... *B41F 15/18* (2013.01); *B41J 11/06* (2013.01); *B65H 2701/174* (2013.01)

(56) References Cited

U.S. PATENT DOCUMENTS

| | | | | |
|---|---|---|---|---|
| 6,439,370 | B1 * | 8/2002 | Hoffman, Jr. ..... | A41H 43/0235 198/468.2 |
| 6,571,697 | B2 | 6/2003 | Eppinger | |
| 10,265,940 | B2 * | 4/2019 | Jess ..... | D06M 17/00 |
| 2001/0029657 | A1 | 10/2001 | Eppinger | |
| 2006/0033796 | A1 | 2/2006 | Samii et al. | |
| 2007/0277919 | A1 * | 12/2007 | Savol ..... | B29C 70/386 156/64 |
| 2015/0124034 | A1 | 5/2015 | Shinoda et al. | |

FOREIGN PATENT DOCUMENTS

| | | | | |
|---|---|---|---|---|
| EP | 1185419 | | 10/2003 | |
| JP | 2004277995 | A * | 10/2004 | ..... B41J 11/002 |
| WO | WO 2008/146143 | | 12/2008 | |
| WO | WO 2019/092727 | | 5/2019 | |

OTHER PUBLICATIONS

International Search Report and the Written Opinion dated Jan. 22, 2019 From the International Searching Authority Re. Application No. PCT/IL2018/051218. (10 Pages).
Translation dated Apr. 22, 2021 of Notification of Office Action dated Mar. 19, 2021 From the State Intellectual Property Office of the People's Republic of China Re. Application No. 201880077153.2. (12 Pages).
Notification of Office Action and Search Report dated Mar. 19, 2021 From the State Intellectual Property Office of the People's Republic of China Re. Application No. 201880077153.2. (9 Pages).
Supplementary European Search Report and the European Search Opinion dated Oct. 14, 2021 From the European Patent Office Re. Application No. 18875145.7. (11 Pages).
Notification of Office Action and Search Report dated Dec. 3, 2021 From the State Intellectual Property Office of the People's Republic of China Re. Application No. 201880077153.2. (11 Pages).
Translation Dated Jan. 18, 2022 of Notification of Office Action dated Dec. 3, 2021 From the State Intellectual Property Office of the People's Republic of China Re. Application No. 201880077153.2. (19 Pages).
English Summary Dated Jul. 20, 2022 of Notification of Office Action and Search Report dated Jun. 16, 2022 From the State Intellectual Property Office of the People's Republic of China Re. Application No. 201880077153.2. (1 Page).
Communication Pursuant to Article 94(3) EPC dated Apr. 5, 2023 From the European Patent Office Re. Application No. 18875145.7 (11 Pages).

* cited by examiner

GRIPPER MECHANISM FOR GARMENT PRINTER

RELATED APPLICATIONS

This application is a National Phase of PCT Patent Application No. PCT/IL2018/051218 having International filing date of Nov. 12, 2018, which claims the benefit of priority under 35 USC § 119(e) of U.S. Provisional Patent Application No. 62/584,831 filed on Nov. 12, 2017. The contents of the above applications are all incorporated by reference as if fully set forth herein in their entirety.

FIELD AND BACKGROUND OF THE INVENTION

The present invention, in some embodiments thereof, relates to a gripper mechanism for a garment printer and, more particularly, but not exclusively, to a gripper for gripping a garment to place on a platen for printing.

Garment printers, especially for adult-sized garments, are large devices and an operator is required to place a garment on the platen and smooth the garment over the platen prior to printer. The operator may be required to carry out the same action hundreds of times a day and the stretching and bending and applying of pressure required can have health consequences for the operator, in particular leading to back pain in the long term.

One solution is to have two-operators, one on each side of the platen, however most garment printers have only limited resources and would not wish to purchase a printer that required them to have a second operator.

SUMMARY OF THE INVENTION

The present inventors have recognized that the issue is not the placing of the garment on the platen but rather the stretching that is required to insert the opposite side of the garment on the opposite side of the platen. No matter what side the operator may stand on, the platen takes up a large area and there is always an opposite side that the operator has to bend towards and then exert some downward pressure, leading to back pain in the long term, due to continuous exertion of pressure from a bent position.

The present embodiments thus may provide for the garment to be placed by the operator on one side of the platen, at which point the loose end of the garment is gripped and pulled over to the opposite side of the platen, and attached to the far side of the platen, leaving the operator merely with the operation of smoothing, which does not involve exerting pressure from a bent position. In some embodiments, the smoothing procedure is attended to as well.

According to an aspect of some embodiments of the present invention there is provided a device for positioning a garment on a printing platen for printing, the device comprising:

a first gripper configured to controllably grip onto a first edge of the garment at a first side of the platen; and a sliding mechanism connected to the gripper and configured to slide the gripper from the first side of the platen to a second side of the platen opposite the first side, thereby to pull the edge to the second side and position the garment across the platen for printing.

The device may comprise a second gripper at a preset distance from the first gripper to controllably grip a second location on the first edge.

The device may comprise an arm holding the first and second grippers at the preset distance.

In an embodiment, at least one of the first gripper and the second gripper is slidable along the arm to adjust the preset distance.

In an embodiment, the arm is attached to the sliding mechanism.

In an embodiment, the arm has a longitudinal axis and the sliding mechanism is configured to slide the arm in a direction perpendicular to the longitudinal axis.

In an embodiment, the sliding mechanism comprises a rail extending along a length of the platen from the first side to the second side, a trolley movable along the rail, and a motor to move the trolley, the gripper being mobile with the trolley.

In an embodiment, the gripper comprises upper and lower components of a vice being closable over the garment edge to hold the garment.

An embodiment may have a housing which holds the sliding mechanism over the platen, the gripper being suspended from the rail.

An embodiment may have a housing in which a hood extends over the platen from above.

An embodiment may comprise a laser source, a photodetector and an indicator, the photodetector positioned to detect occlusions caused by wrinkles or folds of the garment on the platen, the indicator being connected to the photodetector to provide a warning to the operator concerning the wrinkles.

An embodiment may comprise a camera, an image processor and an indicator, the camera positioned to image the garment on the platen, the image processor connected to the camera and configured to identify wrinkles on the garment, and the indicator being connected to the image processor to provide a warning to the operator concerning the wrinkles.

In an embodiment, at least one member of the group consisting of the sliding and the gripping is pneumatically powered.

According to a second aspect of the present invention there is provided a method of setting a garment on a platen for printing, the method comprising:

providing a first edge of the garment at a first side of the platen;

anchoring the first edge at the first side of the platen;

inserting a second edge of the garment into at least one gripper at the first side of the platen;

sliding the gripper from the first side of the platen to a second side of the platen while holding the second edge; and anchoring the second edge at the second side of the platen.

In an embodiment, the inserting the second edge comprises inserting two locations of the second edge into two grippers, the two grippers being at a predetermined distance apart.

An embodiment may comprise sliding the grippers along a rail, the rail extending across a width of the platen.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
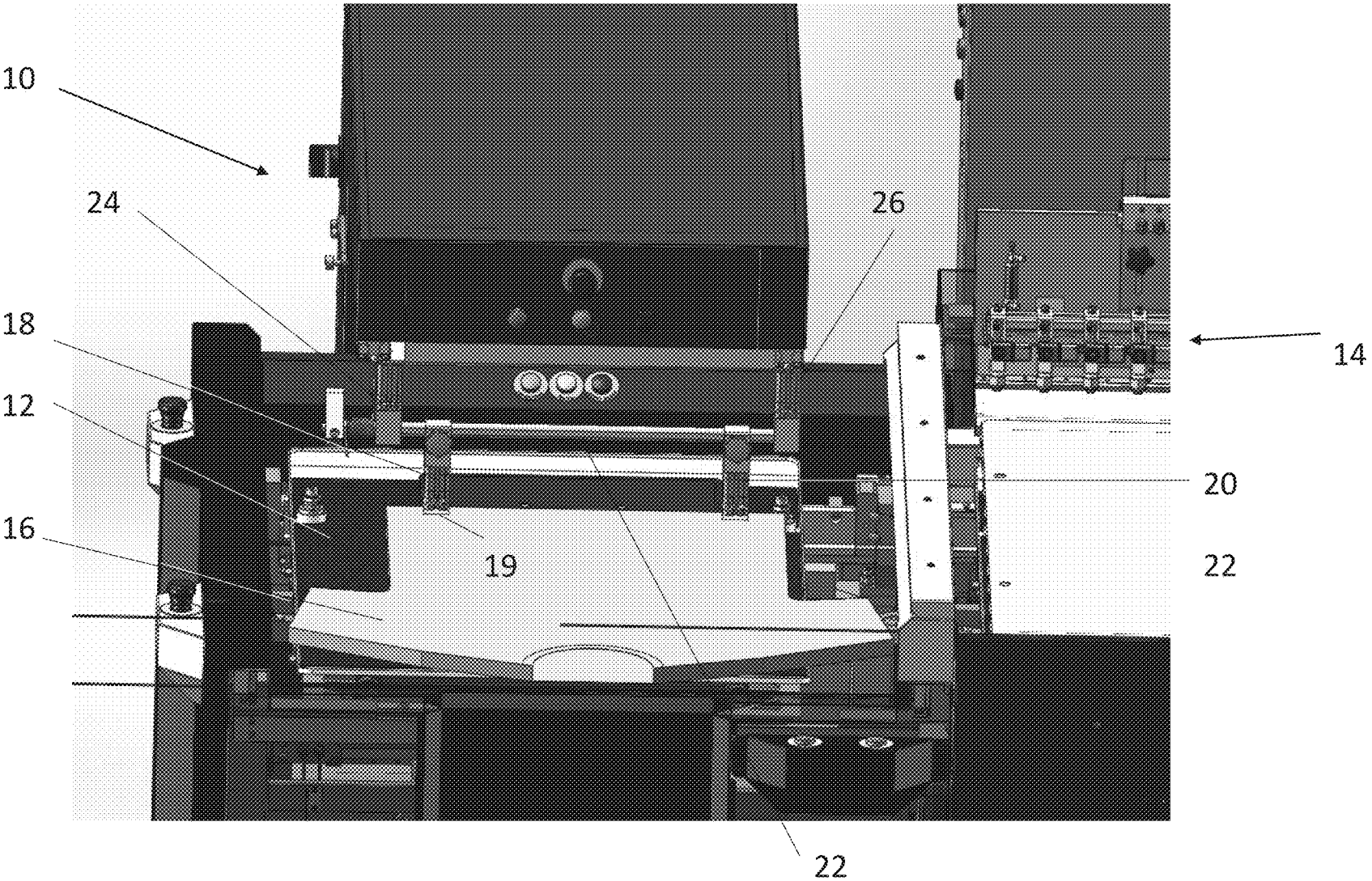
FIG. 1 is a simplified diagram illustrating a first embodiment of a gripper device for loading a platen for printing according to the present invention.

The present invention, in some embodiments thereof, relates to a gripper mechanism for a garment printer and, more particularly, but not exclusively, to a gripper for gripping a garment to place on a platen for printing.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 illustrates a first embodiment of the present invention in which a device for positioning a garment on a printing platen for printing is shown. The figures show the device 10, which is positioned over platen 12. The platen 12 forms the feeder for printer 14, which is partially shown, and in general, a garment 16 is placed smoothly on the platen, which then slides into the printer so that the garment is printed. In the prior art without the device 10, the operator would stand at one side of the platen, anchor one edge of the garment in the platen, then take the second edge of the garment in hand, lean over the platen and anchor the second edge on the other side of the platen. The activity is apparently harmless but is linked to back problems when repeated hundreds of times a day over the course of the use of the machine.

Figure 2:
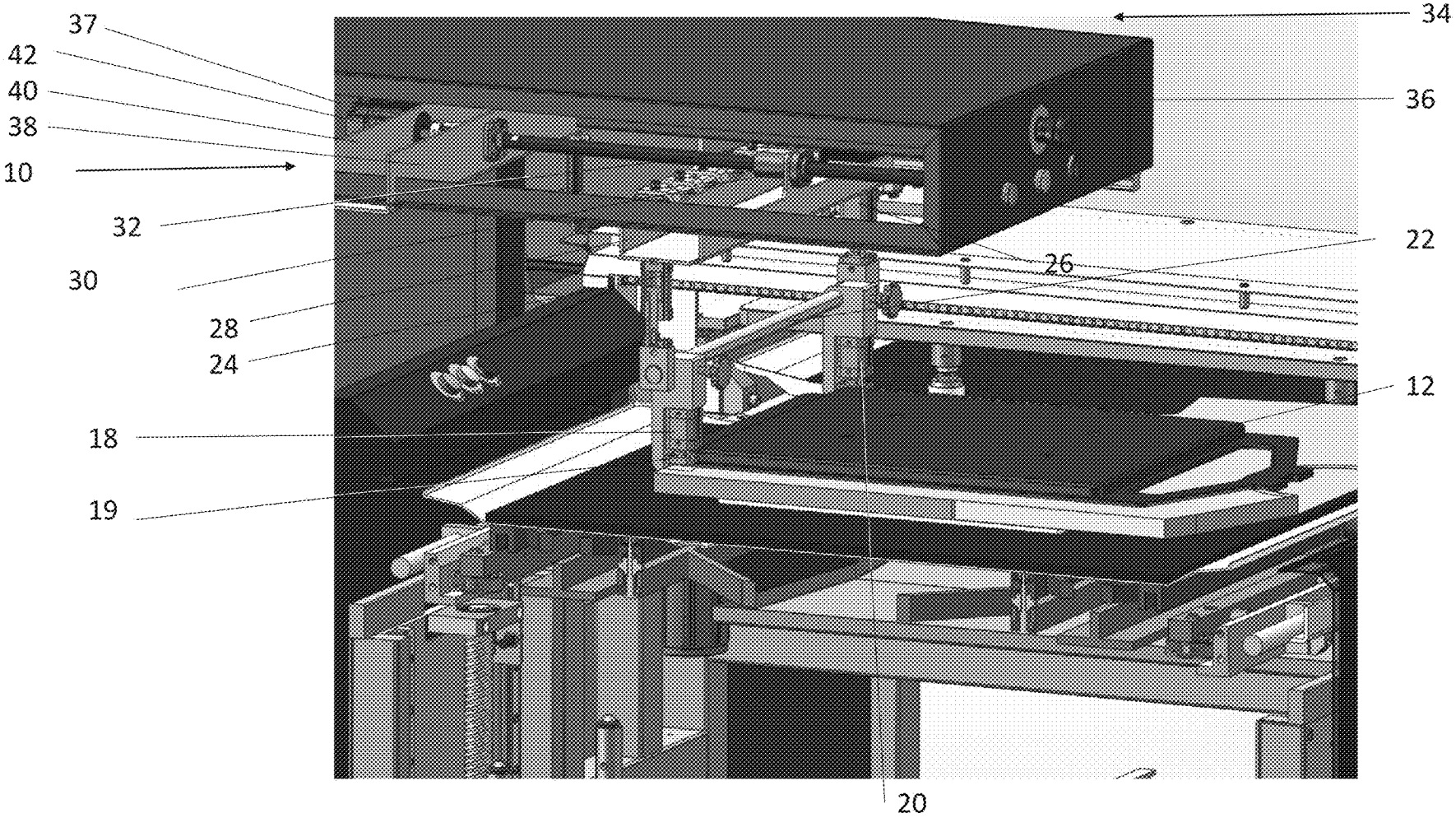
FIG. 2 is a side view of the embodiment of FIG. 1.

The device comprises a first gripper 18, which can be used to controllably grip onto a first edge of the garment at a first side of the platen. The gripper 18 may have a gripping head 19—shown more clearly in FIG. 2, and the gripping head may consist of a claw, a clip, a vice—as shown in FIG. 2—or any other suitable mechanism for taking hold of a garment edge. As shown there is a second gripper 20 spaced from the first gripper 18 along an arm 22. One or both of the grippers may be slidable to adjust for different sizes of garments but in general, the points gripped are intended to be towards the outer corners of the garment so that the garment can be kept taut.

The grippers may be attached to the garment manually by the operator. In another embodiment, the gripper may be actuated and combined with visual and/or tactile sensors to grip the edge of the garment automatically.

Arm 22 is suspended from support arms 24 and 26.

Reference is now made to FIG. 2, which is a simplified diagram showing the device 10 from the side. Arm 22 is below and parallel to upper bar 28 from which it is suspended by the support arms 24 and 26. The upper bar is connected via a sliding connection 30 to rail 32. Thus the sliding connection and the upper bar form a slidable trolley and the grippers are mobile with the trolley. The grippers go back and forth along the platen as the trolley goes back and forth along rail 32. Rail 32 may extend along a length of the platen from one side to the other. The trolley slides along the rail 32, and a motor may be provided to move the trolley. The grippers move with the trolley. The motor may be pneumatic.

The trolley together with the rail and the motor may form a sliding mechanism.

During the motion the grippers 18 and 20 hold an edge of the garment at two locations, preferably as far apart from each other as possible, and pull that edge across the platen so as to set the garment on the platen. As shown, the grippers 18 and 20 have a gripper head 19 which comprises upper and lower jaws of a vice with a space in between into which the edge of the garment is inserted.

The trolley and rail thus provide a sliding mechanism connected to the gripper which slides the gripper across the platen to pull the garment edge to the far side of the platen, so as to position the garment across the platen for printing.

Arm 22, and for that matter upper bar 28, have a longitudinal axis. The direction in which the grippers slide back and forth across the platen is perpendicular to the longitudinal axis of arm 22. On the other hand, the direction in which the grippers may slide in order to adjust the between-gripper distance is along the longitudinal axis of arm 22.

The device 10 includes a housing. The housing positions the rail and the grippers in relation to the platen. Hood 34 may be positioned to extend over the platen from above, to provide an upper part of the housing. Rail 32 may be fixed into the hood at front wall 36, at back wall 37, and at intermediate support brackets 38 and 40. The intermediate support brackets may also hold an enclosure 42 for a motor and control elements. The sliding mechanism and the grippers may be suspended from the rail.

Figure 3:
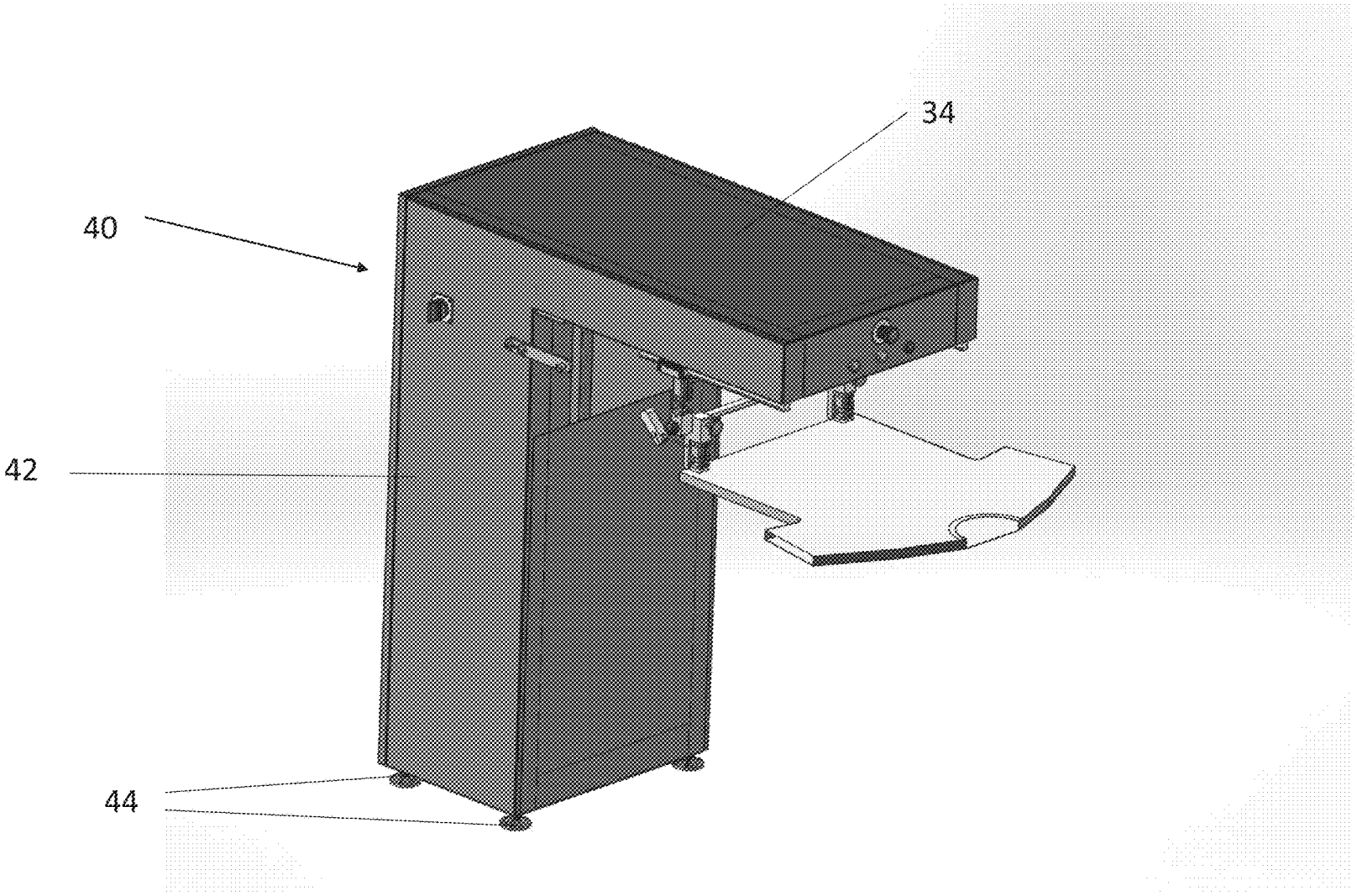
FIG. 3 is a perspective view from above of the device of FIG. 1 with a tee-shirt being gripped and with the platen removed for simplicity.

Reference is now made to FIG. 3, which shows device 10 with a shirt but without the platen. Housing 40 forms an L-shape and provides the device with a support column 42 and hood 34 that extends over the platen. It is noted that the hood actually serves to make it difficult for the operator to manually place the shirt over the platen so that the operator finds it difficult to override the safety feature, which is provided for their protection. Adjustable feet 44 allow the device to be levelled on the factory floor.

The device may include a wrinkle detector to ensure that the garment is placed flat on the platen. In one embodiment the wrinkle detector may be an imaging device that carries out image processing to determine whether the device is flat. An alternative is to use a comb structure made of light wires that are physically displaced by a wrinkle. A third possibility is to use a laser source, a photodetector and an indicator. The photodetector looks along the surface of the garment to be printed to detect occlusions caused by wrinkles or folds of the garment on the platen. The indicator is connected to the photodetector to provide a warning to the operator concerning any wrinkles. The device carries out both sliding and gripping operations, and one or both of the sliding and gripping operations may be pneumatically powered.

Figure 4:
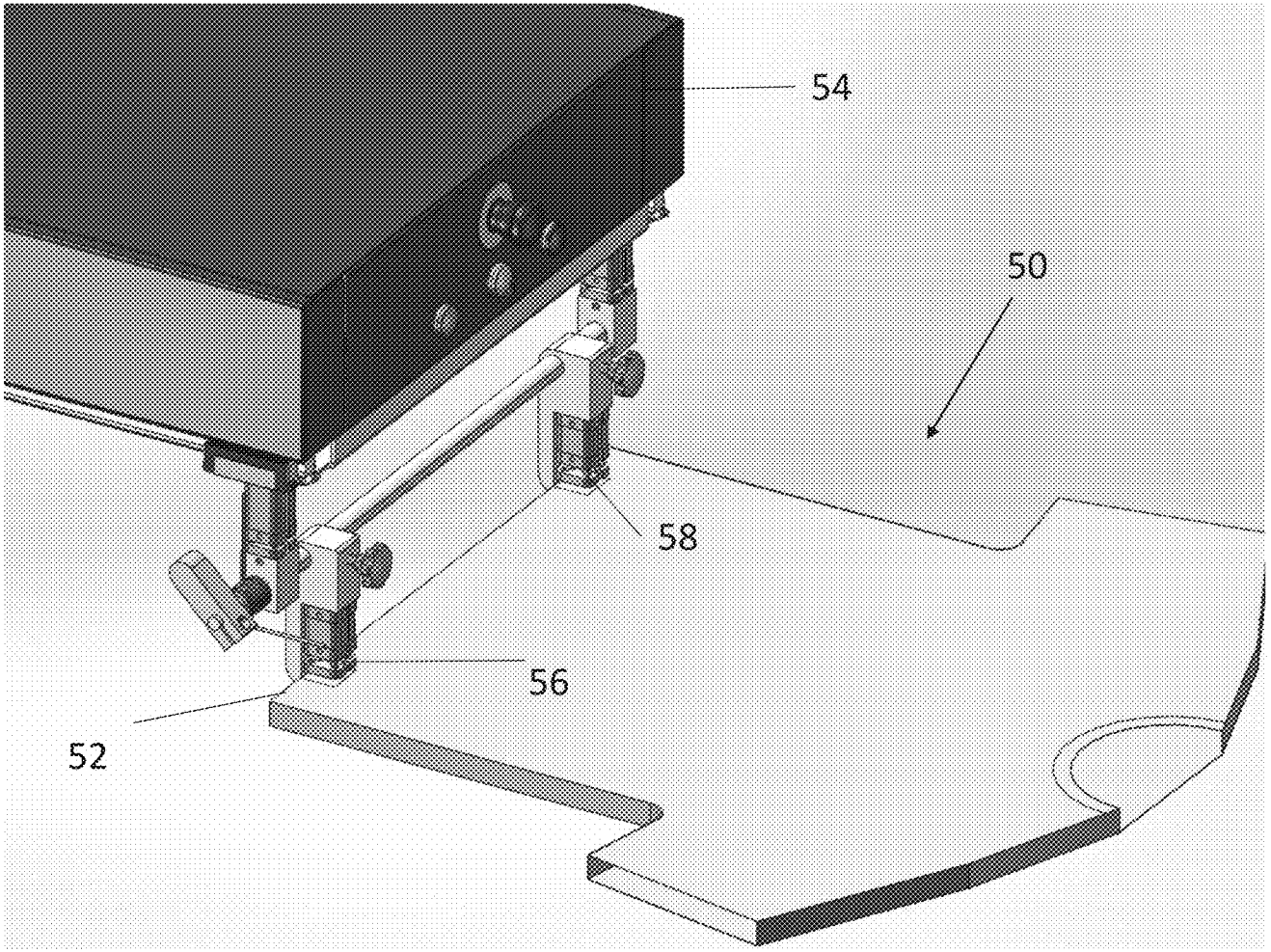
FIG. 4 is a perspective view of the device as in FIG. 3 at a start position.

Reference is now made to FIGS. 4-7, which illustrate successive stages in the use of the gripper of the present embodiments. As shown in FIG. 4, a garment 50 is anchored at one end of a platen—not shown under the garment.

Figure 5:
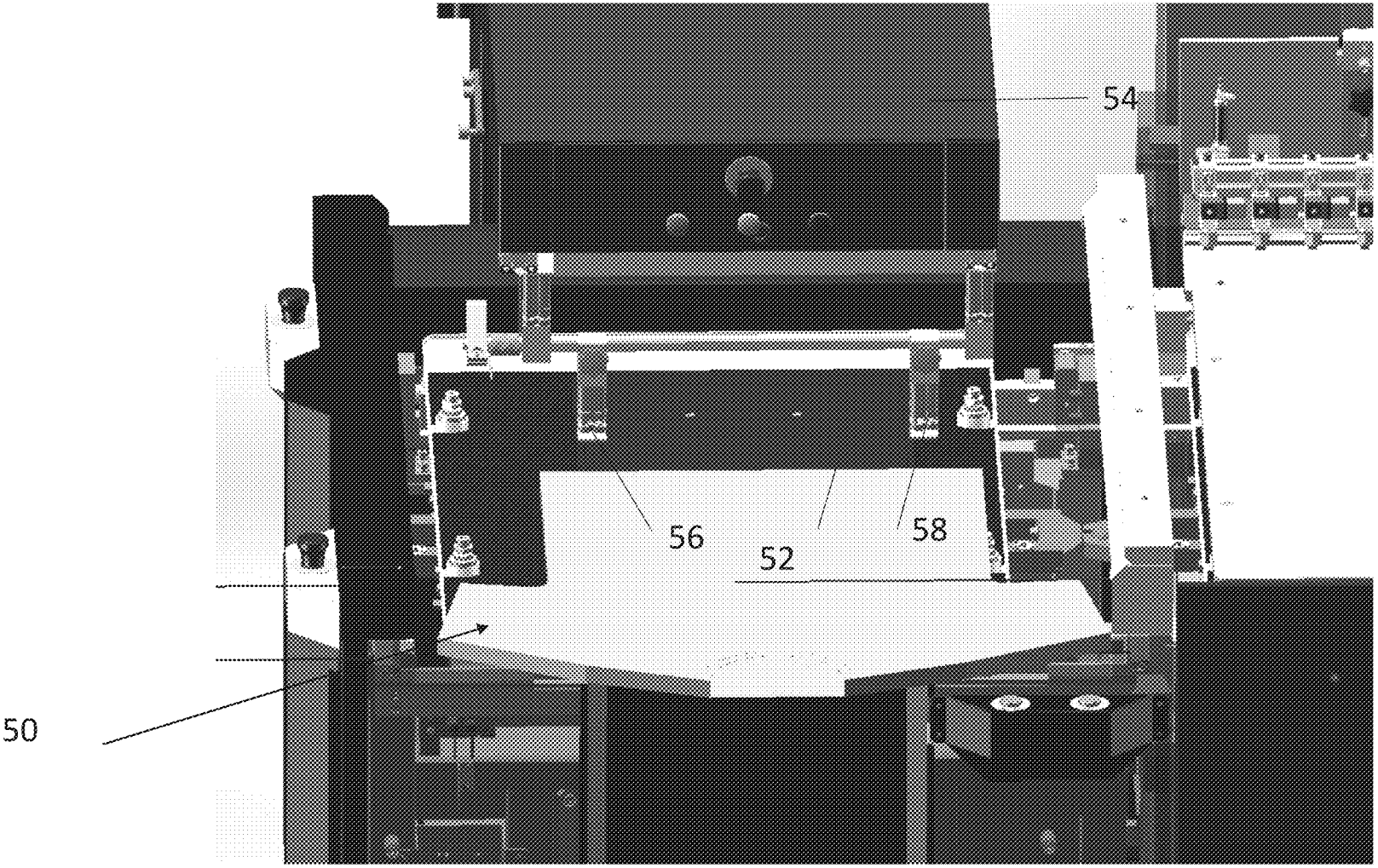
FIG. 5 is a front perspective view of the device with the garment prior to being gripped by the grippers.

The opposite end 52 of the garment is then inserted into a gripper device 54 extending downwardly from hood 54. Typically the gripper includes two gripping claws 56 and 58 and these may grip the garment manually or automatically. FIG. 5 shows the garment after anchoring at the first end and before gripping at the second end.

Figure 6:
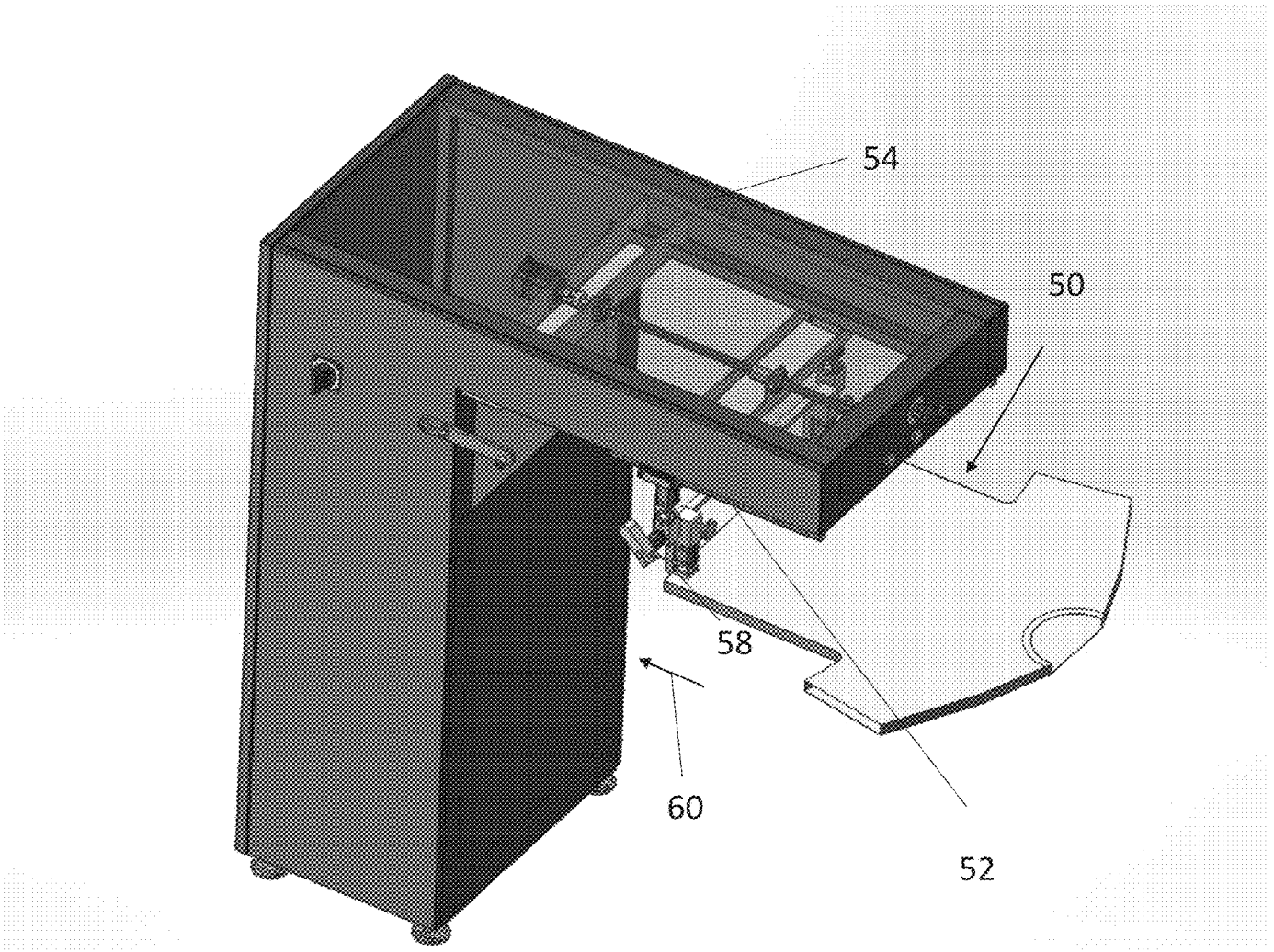
FIG. 6 is the same view as FIG. 3 but with the top cut away to show the sliding mechanism and with the shirt half way along in the sliding process.

In FIG. 6, the gripped second end of the garment 52 slides across to the other side of the platen as the gripper pulls from the first side of the platen to the second side of the platen. Motion of the gripper is in the direction of arrow 60.

Figure 7:
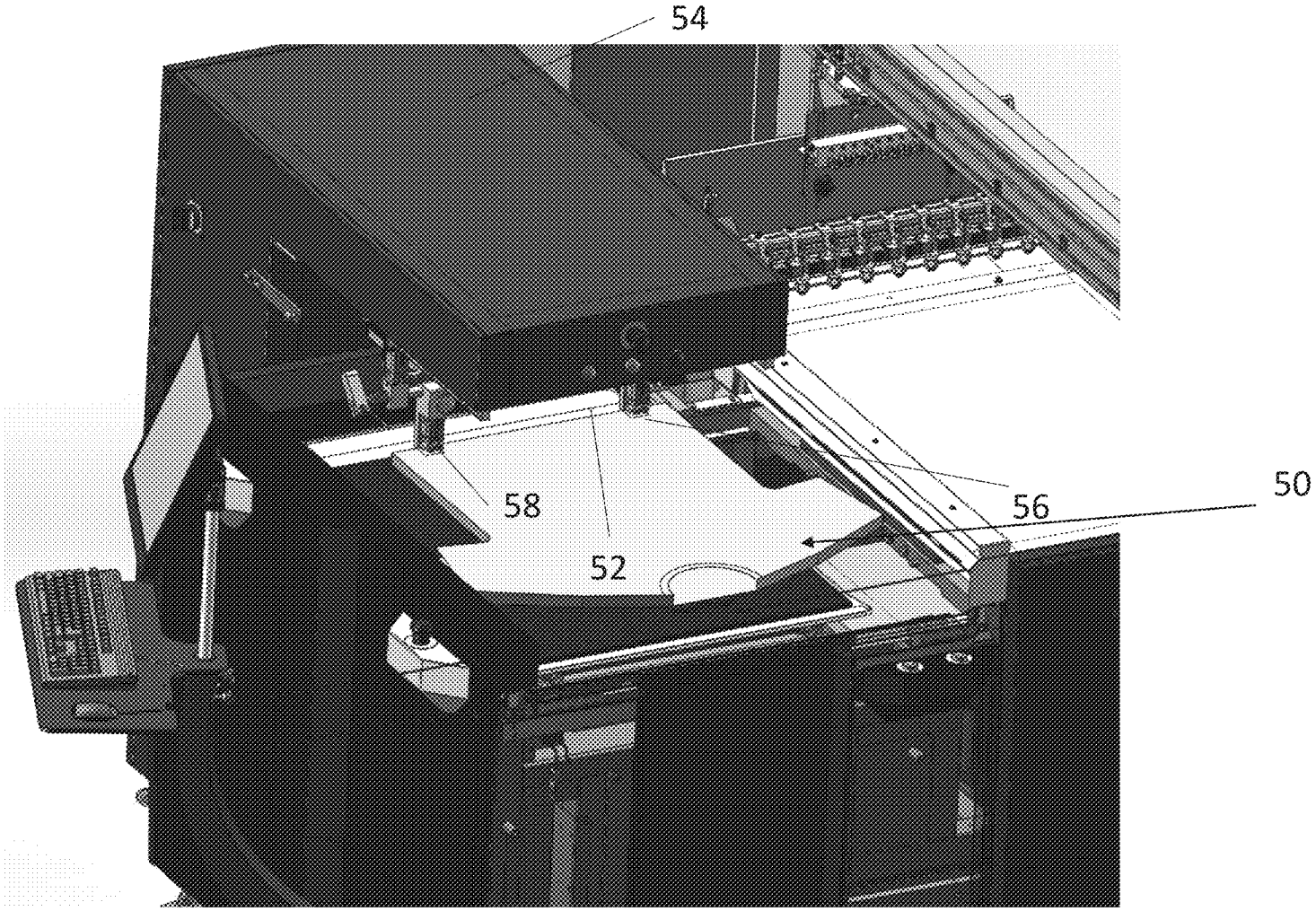
FIG. 7 is a simplified diagram showing the shirt in the final position on the platen ready to enter the printer.

FIG. 7 illustrates the final position of the shirt 50 across the platen and ready to enter the printer. The far end 52 of the shirt is anchored at the far end of the platen.

Inserting the second edge of the garment into the grippers may involve inserting two locations into two grippers and the two grippers may be at a predetermined distance apart, the distance being selected based on the size of the garment, and possibly being adjustable, for example to reduce the size for children's garments.

In this document, the terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention, and the present specification is to be construed as if all such embodiments, including all possible combinations and subcombinations, are explicitly set forth herein. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A device for positioning a garment on a printing platen for digital printing, the device comprising:

a first gripper configured to controllably grip onto a first edge of the garment at a first side of the platen;

a sliding mechanism connected to said gripper and configured to slide said gripper from said first side of the platen to a second side of said platen opposite said first side, thereby to pull said edge to said second side and position said garment across said platen for printing at a digital printer, said sliding mechanism comprising a rail extending along a length of said platen from said first side to said second side, a trolley movable along said rail, and a motor to move said trolley, said gripper being mobile with said trolley;

a laser source;

a photodetector;

an indicator, the photodetector positioned to detect occlusions caused by wrinkles or folds of said garment on said platen, said indicator being connected to said photodetector to provide a warning to said operator concerning said wrinkles; and a housing, the housing holding said sliding mechanism over said platen and said gripper being suspended from said rail within said housing, the housing comprising a hood extending over said platen from above, said hood being located to obscure a platen loading position and thereby prevent manual loading of said garment onto said platen, said first gripper extending downwardly from said hood.

2. The device of claim 1, comprising a second gripper at a preset distance from said first gripper to controllably grip a second location on said first edge.

3. The device of claim 2, comprising an arm holding said first and second grippers at said preset distance.

4. The device of claim 3, wherein at least one of said first gripper and said second gripper is slidable along said arm to adjust said preset distance.

5. The device of claim 3, wherein said arm is attached to said sliding mechanism.

6. The device of claim 5, wherein said arm has a longitudinal axis and said sliding mechanism is configured to slide said arm in a direction perpendicular to said longitudinal axis.

7. The device of claim 1 wherein said gripper comprises upper and lower components of a vice being closable over said garment edge to hold said garment.

8. The device of claim 1, further comprising a camera, and an image processor connected to said indicator, the camera positioned to image said garment on said platen.

9. The device of claim 1, wherein at least one member of the group consisting of said sliding and said gripping is pneumatically powered.

10. A method of setting a garment on a platen for digital printing, the method comprising:

providing a platen loading position covered by a hood, said hood being located to obscure a platen loading position and thereby prevent manual loading of said garment onto said platen;

providing a first edge of said garment at a first side of said platen;

anchoring said first edge at said first side of said platen;

inserting a second edge of said garment into at least one gripper at said first side of said platen, said at least one gripper extending downwardly from said hood;

sliding said gripper from said first side of said platen to a second side of said platen while holding said second edge, said sliding being along a rail, the rail extending across a width of said platen within said hood;

anchoring said second edge at said second side of said platen for said digital printing;

detecting occlusions caused by wrinkles or folds of said garment on said platen, said detecting comprising using a laser source; and, providing a warning to said operator concerning said wrinkles, thereby to prevent digital printing in the presence of wrinkles.

11. The method of claim 10, wherein said inserting said second edge comprises inserting two locations of said second edge into two grippers, the two grippers being at a predetermined distance apart.

* * * * *